US010843218B2

(12) United States Patent
Adams et al.

(10) Patent No.: US 10,843,218 B2
(45) Date of Patent: Nov. 24, 2020

(54) SHEAR STABLE LAMINATION ADHESIVE WITH SPRAY APPLIED ACTIVATOR

(71) Applicants: Steven E. Adams, Richmond, VA (US); Andrew T. Sinclair, Richmond, VA (US); Robert J. Rose, Richmond, CA (US); Ian L. Churcher, Richmond, VA (US)

(72) Inventors: Steven E. Adams, Richmond, VA (US); Andrew T. Sinclair, Richmond, VA (US); Robert J. Rose, Richmond, CA (US); Ian L. Churcher, Richmond, VA (US)

(73) Assignee: Worthen Industries, Nashua, NH (US)

( * ) Notice: Subject to any disclaimer, the term of this patent is extended or adjusted under 35 U.S.C. 154(b) by 332 days.

(21) Appl. No.: 15/380,439

(22) Filed: Dec. 15, 2016

(65) Prior Publication Data

US 2017/0165702 A1 Jun. 15, 2017

Related U.S. Application Data

(60) Provisional application No. 62/267,609, filed on Dec. 15, 2015.

(51) Int. Cl.
*B05C 1/08* (2006.01)
*B05B 13/02* (2006.01)

(52) U.S. Cl.
CPC ..... *B05C 1/08* (2013.01); *B05B 13/0221* (2013.01); *B05C 1/0865* (2013.01); *B05B 13/0207* (2013.01); *B05C 1/0834* (2013.01)

(58) Field of Classification Search
USPC ..... 118/313–315, 304, 324, 325; 156/578
See application file for complete search history.

(56) References Cited

U.S. PATENT DOCUMENTS

| | | | | |
|---|---|---|---|---|
| 2,118,212 | A * | 5/1938 | MacLaurin | D21H 5/0047 101/147 |
| 5,670,211 | A * | 9/1997 | Huber | B05D 1/28 427/207.1 |
| 6,540,829 | B2 * | 4/2003 | Allman | E04D 1/18 118/221 |
| 6,730,411 | B1 * | 5/2004 | Doe | C09J 4/00 428/500 |
| 7,014,724 | B2 * | 3/2006 | Frezza | B05B 12/081 156/578 |
| 2008/0105200 | A1 * | 5/2008 | Lee | B05D 5/068 118/304 |
| 2011/0311833 | A1 * | 12/2011 | Parker | C08G 18/4081 428/474.4 |

* cited by examiner

*Primary Examiner* — Yewebdar T Tadesse
(74) *Attorney, Agent, or Firm* — Lambert Shortell & Connaughton; Gary E. Lambert; David J. Connaughton, Jr.

(57) ABSTRACT

An adhesive application apparatus is provided. The apparatus uses a rolled on adhesive applied to a substrate. After roll application, an adhesive activator is sprayed onto the substrate. By spraying an activator onto the substrate after the adhesive is applied, the adhesive may be made tacky for adhesion, but the adhesive used for rolling may be highly stable and slow to dry/cure without said activator, which enhances rolled application effectiveness.

17 Claims, 2 Drawing Sheets

SHEAR STABLE LAMINATION ADHESIVE WITH SPRAY APPLIED ACTIVATOR

BACKGROUND

In typical rolled adhesive application systems, a substrate is conveyed along a conveyor, and a roller having adhesive applied to it rolls along the substrate, applying an approximately even layer of adhesive to the substrate. As the substrate moves further down the conveyor, the adhesive applied is allowed to dry. In a similar arrangement, the roller may move over a stationary substrate to apply the adhesive.

However, such systems have a number of shortcomings. For example, the rolled-on adhesive must be applied in a relatively thick layer to prevent the adhesive roller from becoming fouled by dried and coagulated adhesive. Any down time of the system inevitably results in even further coagulation. This results in an overuse of adhesive because thick layers are more slow to cure, and can also result in down time on the system when the roller must be cleaned from the dried adhesive. Further, this thick layer takes longer to dry on the substrate, meaning that the substrate and adhesive cannot be packaged immediately and instead must be left until the adhesive is fully dried and the adhered substrates secure. A primary goal in such adhesive application processes is rapid product completion and packaging. Any waiting time between completion and packaging causes a slowdown in the entire process. Further still, the adhesive contains a large percentage of water. If packaged before fully dried, this water can lead to mold, unpleasant odors, substrate material breakdown, and the like.

Therefore, what is needed is a system that may allow for less adhesive to be applied in a rolled system, which may also reduce drying time and increase efficiency, without decreasing the binding efficacy of the adhesive.

SUMMARY

The subject matter of this application may involve, in some cases, interrelated products, alternative solutions to a particular problem, and/or a plurality of different uses of a single system or article.

In one aspect, a two component adhesive application system is provided having a first roller portion for applying a stabilized adhesive to a substrate, and a second sprayer portion for spraying an activator to destabilize the adhesive after it is applied to the substrate. The roller portion uses an adhesive that is stabilized and therefore slower drying than a non-stabilized adhesive. This adhesive can then be activated with the sprayed activator portion which is down stream of the conveyed direction of a substrate from the first roller portion. Activation of the adhesive results in rapid tack and quick binding. As configured, the stabilized adhesive allows a thinner layer of adhesive (and therefore less adhesive overall) to be applied to a substrate than can be done in the prior art. This adhesive can then be rapidly activated by the sprayed activator portion downstream of its application. The sprayed activator may be applied to a full area of the adhesive application on the substrate, or may be applied to substantially less of an area, such as a single center stripe of a fraction of the substrate area, a plurality of stripes, an S shaped pattern, and the like. In another embodiment, the sprayed activator may pulse on and off, covering only a portion of the adhesive covered surface.

In another aspect adhesive application apparatus is provided. The adhesive application apparatus uses a roll applicator which is configured to roll-apply an adhesive to a substrate. A conveyor is provided to move or allow movement of the substrate in an application direction, allowing the roller to apply the adhesive and then move the substrate along so additional adhesive can be applied to the substrate. As adhesive activator sprayer is positioned downstream of the roll applicator in the application direction. The sprayer sprays activator onto the adhesive coated surface, which makes it tacky and more receptive to adhesion.

DETAILED DESCRIPTION

The present invention concerns a two part adhesive application system having an adhesive applied to a substrate by a roller system, and an activator sprayed onto the substrate after application of the adhesive.

The present invention involves a system for applying adhesive to foam using a roller to apply the adhesive, and a sprayer downstream to spray an adhesive activator on at least a portion of the rolled-on adhesive. The adhesive used in the present invention is a stabilized adhesive, configured to only slowly dry and coagulate, unless it is mixed with an activator. The activator is configured to chemically destabilize the adhesive, causing it to be instantly tacky. In one embodiment, the system may use a conveyor to move the substrate relative to the adhesive roller. In another embodiment, a mobile roller may roll along the substrate, and be sprayed with activator after rolling. This present invention may achieve a substantial reduction in the use of adhesive because smaller quantities of the adhesive can be used without the adhesive coagulating prematurely. The present invention may also allow for less water use, and more rapid binding of adhered substrates, and thus more rapid assembly and packaging. In some embodiments, the present invention may achieve up to a 20% to 30% reduction in overall adhesive use compared to current rolled adhesive application systems.

The activator is sprayed from a spray gun down stream of the roller. However, it should be understood that any spraying system may be used, including both air atomized sprayers, and airless sprayers. The term sprayer is used herein generally to refer to any structure capable of spraying a fluid towards a substrate. The activator may be sprayed on all, or only a part of the area on which the adhesive is applied, depending on embodiment and system needs. In varying embodiments, the activator spray area and/or the sprayed volume may be adjusted depending on size, weight, porosity, and other properties of the two substrates being adhered. For example, a larger activator spray area and/or higher volume of activator may be used to bond heavier substrates that would be likely to separate, while a small area and/or volume of activator may be used for a light or non-porous material. In some embodiments, the activator may be sprayed on an area that is between 5%-50% of the area sprayed with adhesive. Typical area ranges may be between 15%-33%, but as noted may vary depending on the substrates at issue. It should be understood that any area of activator spray may be used including fully covering the adhesive application area. For example, the activator may be sprayed over 100%, 85%, 75%, 65%, 50% etc. of the adhesive application area, without straying from the scope of the present invention.

Figure 1:
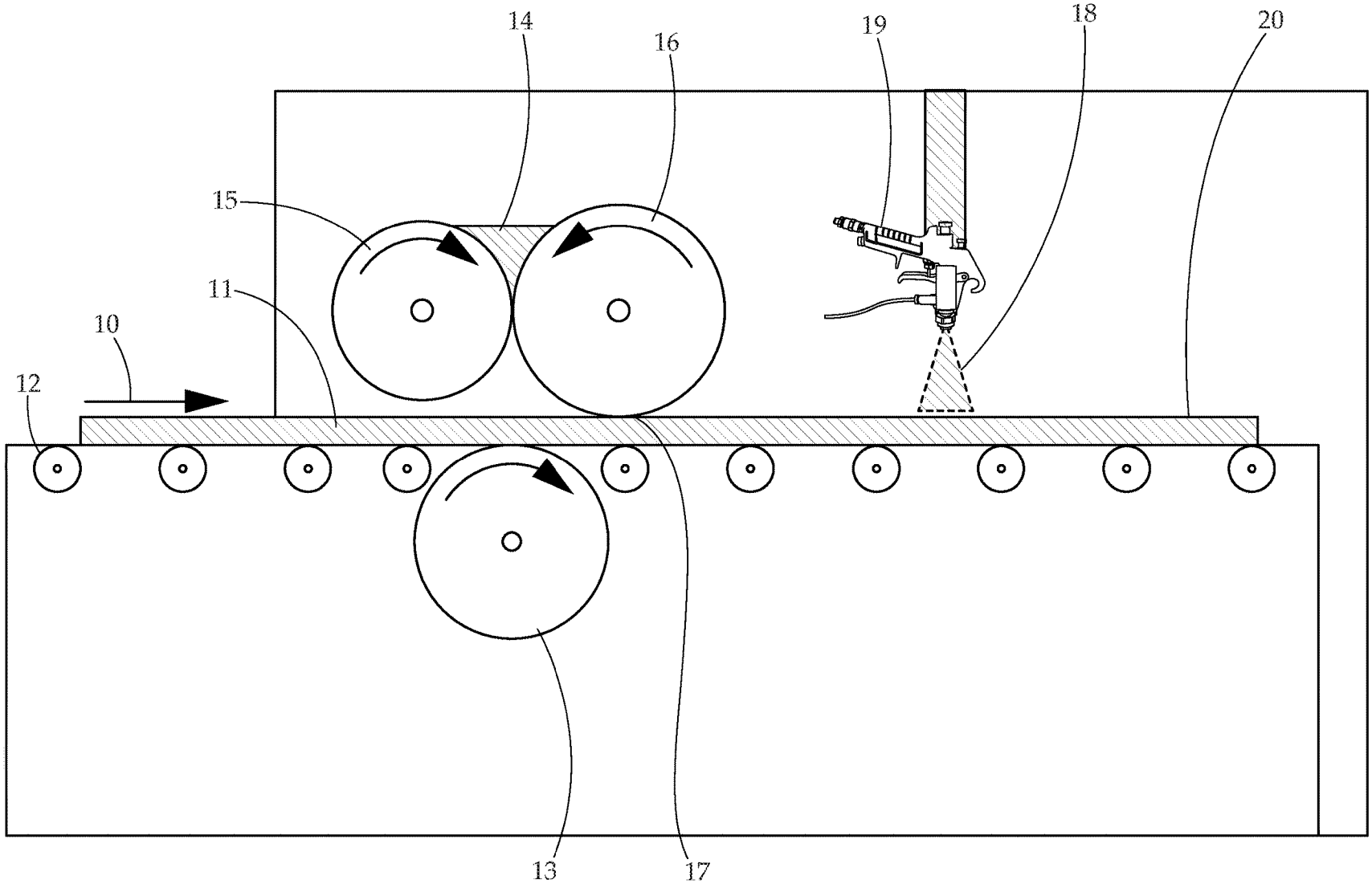
FIG. 1 provides a schematic view of an embodiment of the present invention.

Turning now to FIG. 1, an embodiment of the invention is shown. A substrate, shown in this embodiment as a foam sheet 11 is positioned on a conveyor 20. The conveyor 20 may be any structure capable of moving the foam sheet 11 along a path. In the conveyor embodiment shown in FIG. 1, the conveyor comprises a plurality of rollers. In some cases, a belt may be positioned over this plurality of rollers, though this is not necessarily the case. Further, in the embodiment shown, a drive roller 13 provides a motive force to the foam 11, urging it along in the foam travel direction, as indicated by arrow 10. Adhesive is applied to a top surface 17 of the foam 11 by a roller 16. In this embodiment, two rollers are provided, the primary roller 16, and a secondary roller 15 which creates an adhesive trough 14 between the two rollers, and provides a smooth application of adhesive to the primary roller 16, for deposition onto the foam top surface 17. These rollers 15, 16, are configured to rotate in opposite directions. A gap, or an amount of pressure applied between the two rollers 15, 16 controls the quantity of adhesive on the roller, and thus the thickness of the adhesive layer applied to the substrate (in this case, foam 11). Of course, other roller systems may be used without straying from the scope of the present invention. It should be understood that the present invention is not limited to adhesive application to foam. Indeed, any substrate may be processed having the stabilized adhesive applied by the roller and activator later applied without straying from the scope of the present invention. Because the adhesive layer of the present invention applied to the substrate can be much thinner (because of the use of a more stable adhesive which is activated (made more tacky) after the application) than that of the prior art, the gap between the primary and secondary roller may likewise be smaller than gaps between the primary and secondary rollers currently in use.

Downstream of the foam travel direction, this embodiment provides an activator application. In this view, the activator 18 is sprayed onto the surface 17 of the foam 11 after the adhesive has been applied. A sprayer 19, shown here as a spray gun is used to apply the activator 18. The activator, once mixed with the adhesive, provides instant tack, allowing the substrate foam 11 to be adhered to another material (or itself). While a spray gun 19 is shown as the activator spray device, it should be understood that any spraying mechanism, airless, air atomized, or the like, may be used, without straying from the scope of this invention.

Figure 2:
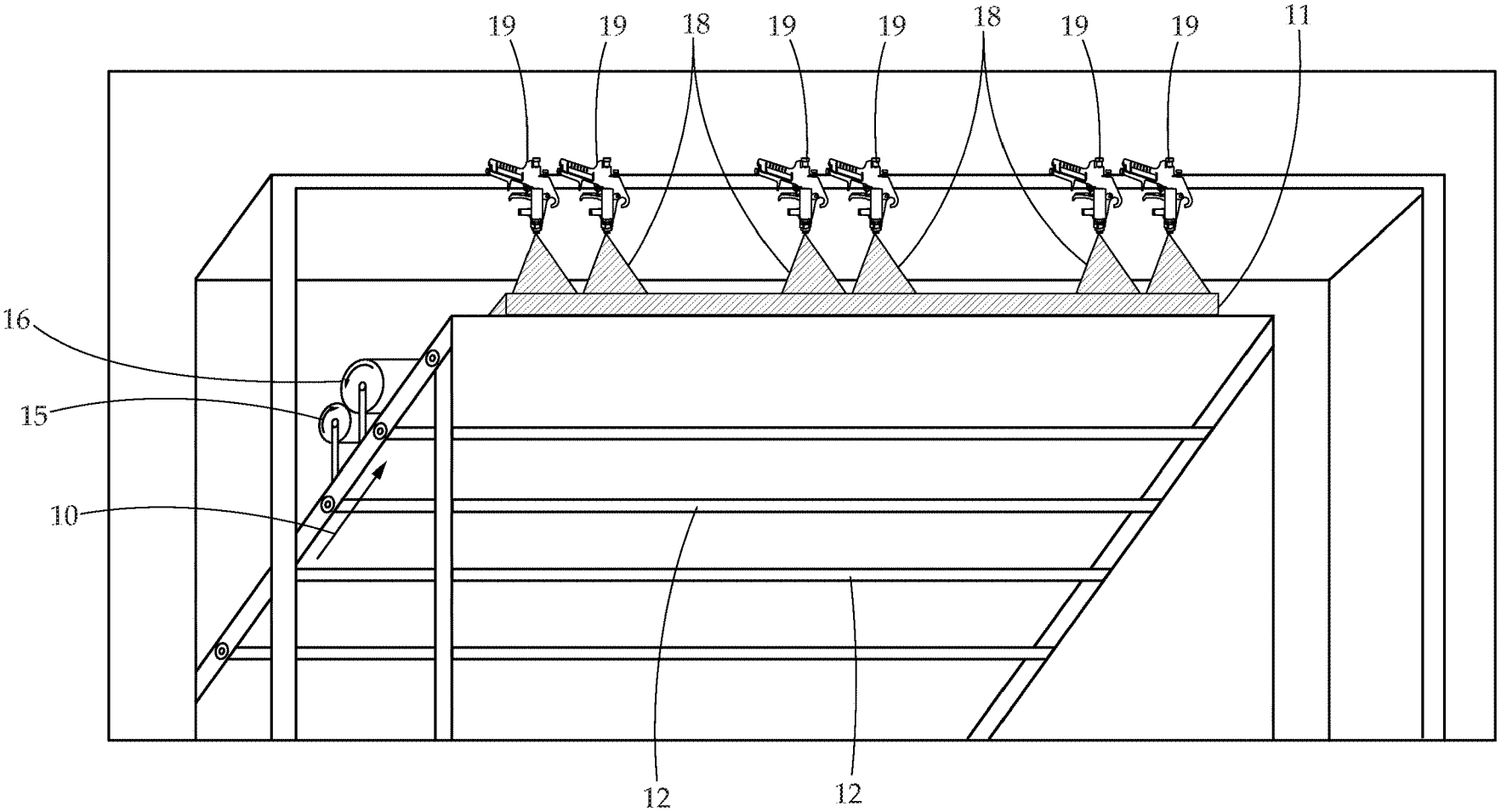
FIG. 2 provides a perspective view of an embodiment of the present invention.

FIG. 2 provides a perspective view of another embodiment of the present invention. A foam substrate 11 is moved along the conveyor 20 in direction 10. Primary roller 16 provides application of adhesive to a top surface of the foam 11. Secondary roller 15 may roll against or adjacent to primary roller 16. Downstream in the direction of the substrate travel on the conveyor are six activator sprayers 19. In this view, the sprayers 19 are shown as spray guns, but it should be understood that any spraying mechanism may be used that can spray or otherwise atomize activator fluid directed at a substrate. In this embodiment, the sprayers 19 are configured to spray the activator in three strips along the length of the substrate foam. As such, the sprayers 19 are configured to only spray activator 18 along a portion of the foam 11 top surface. Therefore, in this embodiment the activator will not be sprayed on the entire area of the foam that has had the adhesive applied, but instead approximately 50% of the adhesive area. It should be understood that in varying embodiments, different activator spray systems and configurations may be used without straying from the scope of the present invention.

By not applying activator 18 to an entire top surface, sufficient tack may be achieved for rapid adhesion, and the non-activated may be allowed to dry more slowly, eventually resulting in a bonding to reinforce the activated adhesive bond area. Such a configuration may result in less activator and adhesive use, as well as limiting a water applied to the foam (the activator typically being water-based).

The resultant product after use of the two component adhesive applying system is a substrate having a surface coated with an adhesive, with at least part of this adhesive having been activated by a spray applied activator. This activator makes the adhesive instantly tacky and ready for rapid adhesion of another surface. The activator may cover the full adhesive covering, or may be applied to a portion of the adhesive in a strip, patter, or the like.

Generally, the adhesive contemplated herein may be any stabilized adhesive. In some embodiments, the adhesive may be selected to be a polychloroprene latex base that can have other lattices such as styrene butadiene rubber (SBR), Acrylic, Vinyl Acetate Ethylene (VAE), Poly-Vinyl Acetate (PVA), Vinyl Acrylic, Nitrile, Styrene Acrylic, Polyisoprene, Butyl Rubber, Guayule, Natural rubber and the like may be added as well. A pH of the adhesive is lowered using Glycine, or other acid such as glycolic, lactic, citric, ascorbic, boric, and the like. Stabilizers are further added. The stabilizers may be any of: anionic soaps, nonionic surfactants, polymeric thickeners, and water. In a particular embodiment, the adhesive used herein may be SprayClean® 1404, Fabond, or equivalent from Worthen Industries. In another embodiment, the adhesive may be selected to have a SBR base. This SBR based adhesive may further have other lattices such as those listed above, as well as a polychloroprene latex. In still another embodiment, the adhesive may be selected to have a natural rubber latex base. This natural rubber latex based adhesive may further have other lattices such as those listed above, as well as a polychloroprene latex.

The activator contemplated herein may be any acid or salt solution or dispersion capable of activating the adhesive component, making it highly tacky and adherent when the two mix. Examples of activators may include, but are not limited to: Acids such as: hydrochloric acid, phosphoric acid, sulfuric acid, nitric acid, boric acid, oxalic acid, acetic acid, citric acid, lactic acid, glycolic acid, propionic acid, glycine, alanine, valine, leucine, isoleucine, lycine; sulfate salts such as: zinc sulfate, potassium sulfate, sodium sulfate, magnesium sulfate, calcium sulfate, ammonium sulfate; nitrate salts such as: zinc nitrate, potassium nitrate, sodium nitrate, magnesium nitrate, calcium nitrate and ammonium nitrate; ammonium salts such as: ammonium nitrate, ammonium sulfate, ammonium chloride; chloride salts such as: zinc chloride, potassium chloride, sodium chloride, magnesium chloride, calcium chloride, and the like. These acids and salts are generally solvated in water at varying concentrations, typically at 30% or less. More typically in the range of 2 to 15%. In another embodiment, the activator may be a dispersion of sodium silicofluoride in water, or other similar dispersion.

For the present invention, the volume ratio of adhesive to activator may be about 25:1 in the area with both adhesive and activator applied. More preferably approximately 10:1 (again for the area having with both adhesive and activator applied, applicable to the remainder of the ratios discussed herein) with the best results at approximately 5:1. However, the invention will work with a ratio range of 2:1 to 50:1 adhesive to activator.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention.

What is claimed is:

1. An adhesive application apparatus comprising:

a roll applicator configured to roll-apply an adhesive to a substrate;

an activator sprayer positioned downstream of the application direction, the activator sprayer positioned in a direction to spray an adhesive activator on the substrate after the application of the adhesive; and wherein the activator sprayer is positioned to cause an activator spray to contact approximately 5%-50% of the surface area of the substrate.

2. The adhesive application apparatus of claim 1 further comprising a conveyor configured to allow movement of the substrate in an application direction, the roll applicator configured to apply the adhesive to the substrate on the conveyor.

3. The adhesive application apparatus of claim 2 wherein the conveyor is a motorized conveyor.

4. The adhesive application apparatus of claim 1 wherein the substrate is a foam.

5. The adhesive application apparatus of claim 1 wherein the sprayer is a spray gun.

6. The adhesive application apparatus of claim 1 wherein the sprayer is a mechanized sprayer.

7. The adhesive application apparatus of claim 1 further comprising a plurality of activator sprayers arranged to spray along a width of the substrate.

8. The adhesive application apparatus of claim 1 wherein the roll applicator is formed as a primary roller in contact with the substrate, a secondary roller in contact with the primary roller, and an adhesive trough formed between the primary roller and the secondary roller.

9. The adhesive application apparatus of claim 1 wherein the activator is applied in at a volume ratio of 25:1 to 2.5:1 activator to adhesive.

10. The adhesive application apparatus of claim 1 wherein the sprayer is movable.

11. An adhesive application conveyor system comprising:

a quantity of adhesive;

a roll applicator in communication with the quantity of adhesive and configured to roll-apply an adhesive to a first substrate;

a conveyor configured to move the first substrate in an application direction, the roll applicator configured to apply the adhesive to the first substrate on the conveyor;

a quantity of adhesive activator capable of destabilizing the adhesive;

a plurality of adhesive activator sprayers positioned downstream from the roll applicator in the application direction, the plurality of adhesive activator sprayers directed to spray an adhesive activator on the first substrate after the application of the adhesive; and wherein upon a mixing of the adhesive and adhesive activator, a second substrate may be adhered to the first substrate by the adhesive and adhesive activator mixture at a surface of the first substrate receiving the adhesive and adhesive activator; and wherein the plurality of sprayers are positioned to spray the activator on approximately 5%-50% of the surface area of the first substrate.

12. The adhesive application conveyor system of claim 11 wherein the first substrate is a foam and further comprising the first foam substrate on a surface of the conveyor.

13. The adhesive application conveyor system of claim 11 wherein the conveyor is a motorized conveyor.

14. The adhesive application conveyor system of claim 11 wherein the plurality of sprayers are configured to spray the activator on only a portion of the first substrate.

15. The adhesive application conveyor system of claim 11 wherein the activator is applied in at a ratio of 25:1 to 2.5:1 activator to adhesive.

16. The adhesive application conveyor system of claim 11 wherein the roll applicator provides a force to the first substrate to move the first substrate along the conveyor.

17. The adhesive application conveyor system of claim 11 wherein the adhesive is one of a polychloroprene latex based adhesive, a styrene butadiene rubber based adhesive, and a natural rubber latex based adhesive, and wherein the activator may be one of an acid solution or dispersion, a salt solution or dispersion, and an acid and salt solution or dispersion.

* * * * *